US009365039B2

(12) United States Patent
Tatsumi et al.

(10) Patent No.: US 9,365,039 B2
(45) **Date of Patent: *Jun. 14, 2016**

(54) LIQUID JET HEAD, METHOD FOR MANUFACTURING LIQUID JET HEAD, AND LIQUID JET APPARATUS

(71) Applicants: SII PRINTEK INC., Chiba-shi, Chiba (JP); SEIKO INSTRUMENTS INC., Chiba-shi, Chiba (JP)

(72) Inventors: Tokio Tatsumi, Chiba (JP); Satoshi Horiguchi, Chiba (JP)

(73) Assignees: SII PRINTEK INC. (JP); SEIKO INSTRUMENTS INC. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/641,823

(22) Filed: Mar. 9, 2015

(65) Prior Publication Data

US 2015/0258790 A1 Sep. 17, 2015

(30) Foreign Application Priority Data

Mar. 12, 2014 (JP) ..... 2014-049361

(51) Int. Cl.

| | |
|---|---|
| ***B41J 2/045*** | (2006.01) |
| ***B41J 2/14*** | (2006.01) |
| ***B41J 2/16*** | (2006.01) |

(52) U.S. Cl.

CPC ..... *B41J 2/14209* (2013.01); *B41J 2/1609* (2013.01); *B41J 2/1623* (2013.01); *B41J 2/1631* (2013.01); *B41J 2/1632* (2013.01); *B41J 2/1643* (2013.01); *B41J 2/14072* (2013.01); *B41J 2002/14491* (2013.01); *Y10T 29/49401* (2015.01)

(58) Field of Classification Search

CPC .. B41J 2/14072; B41J 2/3351; B41J 2/14201; B41J 2/14209

See application file for complete search history.

(56) References Cited

U.S. PATENT DOCUMENTS 5,650,810 A * 7/1997 Muto ..... B41J 2/1609 264/328.1
2015/0258782 A1* 9/2015 Horiguchi ..... B41J 2/14 347/54

FOREIGN PATENT DOCUMENTS

| | | |
|---|---|---|
| GB | 2499508 | 8/2013 |
| JP | 10244667 | 9/1998 |
| JP | 2001341298 | 12/2001 |
| JP | 2007307735 | 11/2007 |
| JP | 2012011704 | 1/2012 |
| JP | 2013193313 | 9/2013 |

OTHER PUBLICATIONS

Intellectual Property Office Search Report mailed Sep. 1, 2015 issued in Appln. No. GB1504169.2.

* cited by examiner

*Primary Examiner* — Geoffrey Mruk
(74) *Attorney, Agent, or Firm* — Adams & Wilks

(57) ABSTRACT

A liquid jet head includes a base plate, and an actuator portion fixed to the base plate and having an array of alternating ejection channel and a dummy channel. drive electrodes are formed on inner surfaces of the ejection channels and the dummy channels, and extracting electrodes are formed on the base plate on a rear side of the actuator plate and electrically connected to the drive electrodes. an electrode formation region of the base plate on which are formed the extracting electrodes has a surface roughness greater then that of other regions of the base plate.

20 Claims, 11 Drawing Sheets

LIQUID JET HEAD, METHOD FOR MANUFACTURING LIQUID JET HEAD, AND LIQUID JET APPARATUS

BACKGROUND

1. Technical Field

The present invention relates to a liquid jet head, a method for manufacturing the liquid jet head, and a liquid jet apparatus.

2. Related Art

Conventionally, an apparatus for printing images and characters by ejecting droplet ink (hereinafter, referred to as the ink droplet simply) to a recording medium includes an ink jet printer (liquid jet apparatus) having an ink jet head (liquid jet head) that ejects the ink droplets from a plurality of nozzle holes to the recording medium.

As the above ink jet head, JP 2001-341298 A discloses an ink jet head that includes a base plate made of glass, and a plurality of barrier walls arranged on the base plate and made of piezoelectric material, in which a channel is provided to contain ink between the barrier walls. A drive electrode is formed on a side surface of the barrier wall, and electrically connected to an extracting electrode formed on the base plate. Thus, the extracting electrode is connected to a flexible substrate provided on an outside of the barrier walls.

According to this configuration, when a voltage is applied to the drive electrode through the flexible substrate and the extracting electrode, the barrier wall is changed in shape, and a pressure in the channel is increased, so that the ink contained in the channel is ejected through the nozzle hole.

However, according to the configuration of the JP 2001-341298 A, it is necessary to separately perform the step of forming the extracting electrode on the base plate, and the step of forming the drive electrode on the side surface of the barrier wall, so that the problem is that a manufacturing process has many steps, and becomes complicated.

In addition, according to the configuration of the JP 2001-341298 A, the ink jet head employs a three-cycle method in which the ink is introduced to each channel, and the ink is sequentially ejected from each channel, so that when conductive ink such as water-based ink is used, a short circuit is caused between the drive electrodes through the ink. Therefore, various kinds of ink cannot be used in the configuration of the JP 2001-341298 A, so that there is a room for improvement in enhancing convenience.

SUMMARY

The present invention has been made in view of the above circumstances, and its object is to provide a liquid jet head capable of efficiently performing and simplifying manufacturing process steps, a method for manufacturing the liquid jet head, and a liquid jet apparatus.

The present invention provides the following things in order to solve the above problems.

A liquid jet head according to an aspect of the present invention includes a base plate, an actuator portion fixed to the base plate, and having a jet channel to be filled with a liquid and a dummy channel not to be filled with a liquid, in which the jet channel and the dummy channel are juxtaposed to each other, a jet hole plate arranged on one side end of the actuator portion in an extending direction of the jet channel and the dummy channel, and having juxtaposed jet holes configured to communicate with the jet channels, a drive electrode formed on each of inner surfaces of the jet channel and the dummy channel, and an extracting electrode formed on the base plate to be located on the other side end of the actuator portion in the extending direction and electrically connected to the drive electrode, wherein an electrode formation region to form the extracting electrode has a surface roughness greater than a surface roughness in a region other than the electrode formation region, in the base plate.

Furthermore, a method for manufacturing the liquid jet head according to the aspect of the present invention includes the steps of roughening the electrode formation region in the base plate, bonding and fixing the actuator portion to the base plate, and forming electrodes with a plated film on the electrode formation region in the base plate, the inner surfaces of the jet channel, and the inner surfaces of the dummy channel.

According to this configuration, the surface roughness of the electrode formation region is greater than that of the other region in the base plate, so that in a case where the drive electrode and the extracting electrode are formed by plating, an anchor effect can be provided in the electrode formation region. That is, in the electrode forming step, the plated film can be precipitated only in the electrode formation region while the plated film is not precipitated in the region (non-formation region) other than the electrode formation region, in the base plate. Thus, the plated film can be selectively formed in a desired region in the base plate. In this case, after the base plate and the actuator portion have been bonded, the drive electrode and the extracting electrode can be collectively formed in the base plate and the actuator portion with the plated film. As a result, the manufacturing process steps can be efficiently performed and simplified, compared with the case where the extracting electrode and the drive electrode are separately formed in the base plate and the actuator portion, respectively.

Furthermore, as for the liquid jet head according to the aspect of the present invention, the drive electrode and the extracting electrode may be integrally formed with the plated film.

According to this configuration, the manufacturing process steps can be efficiently performed and simplified, compared with the case where the extracting electrode and the drive electrode are separately formed in the base plate and the actuator portion, respectively.

Furthermore, as for the liquid jet head according to the aspect of the present invention, a surface roughness Ra of the electrode formation region may be equal to or more than four times as great as a surface roughness Ra of the region other than the electrode formation region.

Furthermore, as for the liquid jet head according to the aspect of the present invention, the surface roughness Ra of the electrode formation region may be equal to or more than 400 Å.

According to this configuration, the anchor effect can be sufficiently provided in the electrode formation region, so that the plated film having an enough thickness can be evenly formed in the electrode formation region.

Furthermore, as for the liquid jet head according to the aspect of the present invention, the base plate may be made of glass material.

According to this configuration, the base plate is made of the glass material, so that the surface roughness Ra of the non-formation region can be small. In this case, since the plated film can be prevented from being formed in the non-formation region, a patterning step after the plated film has been formed is not needed, so that the manufacturing process steps can be efficiently performed, and manufacturing cost can be reduced.

Furthermore, as for the liquid jet head according to the aspect of the present invention, the drive electrode may include a common electrode formed on the inner surface of the jet channel, a ground terminal to be connected to the extracting electrode may be formed in the actuator portion to be located outside the dummy channel located in an outermost end in a juxtaposed direction of the jet channel and the dummy channel, a cover plate having a liquid chamber configured to communicate with the jet channels may be arranged on a main surface of the actuator portion on a side opposite to a side of the base plate, and a connection wiring may be formed in the cover plate to connect the common electrode to the ground terminal.

According to this configuration, the common electrode and the ground terminal are connected through the connection wiring formed in the cover plate, so that the common electrode can communicate with the ground terminal only by bonding the actuator portion to the cover plate. Thus, the manufacturing process steps can be more efficiently performed.

Furthermore, as for the liquid jet head according to the aspect of the present invention, the drive electrode may include an individual electrode formed on the inner surface of the dummy channel, a groove portion may be formed in the main surface of the actuator portion to be located between the common electrode and the individual electrode, and the connection wiring may be arranged in a position corresponding to the groove portion.

According to this configuration, the connection wiring is arranged in the position corresponding to the groove portion formed in the main surface of the actuator portion, so that the connection wiring is prevented from coming into contact with the common electrode and the individual electrode, and the short circuit can be prevented from being caused between the common electrode and the individual electrode through the connection wiring. Thus, the liquid jet head can be superior in reliability.

As for the liquid jet head according to the aspect of the present invention, the actuator portion may include channel blocks arranged at intervals in the juxtaposed direction of the jet channel and the dummy channel so that the jet channel is formed in each of the channel blocks, the drive electrode may include an individual electrode formed on opposed surfaces of the channel block configured to constitute the dummy channel, the dummy channel may be made up of the adjacent channel blocks and the base plate, and the region other than the electrode formation region may include a portion constituting the dummy channel, in the base plate.

According to this configuration, the plated film is not precipitated in the portion constituting the dummy channel (that is, the portion serving as the bottom surface of the dummy channel) in the base plate. Therefore, when the individual electrode is formed by plating, the plated film can be precipitated only on the side wall surfaces (opposed surfaces of the channel blocks) while the plated film is not precipitated in the bottom surface (the portion located between the channel blocks in the base plate), among the inner surfaces of the dummy channel. Thus, it is not necessary to remove the plated film precipitated on the bottom surface of the dummy channel with laser in a subsequent process, so that manufacturing cost can be reduced, and dust to be generated in the subsequent process can be eliminated. Furthermore, the individual electrodes formed on the side wall surfaces of the dummy channel can be surely prevented from causing the short circuit through the bottom surface.

A liquid jet apparatus according to an aspect of the present invention includes the liquid jet head according to the aspect of the present invention, and a moving mechanism configured to relatively move the liquid jet head and a recording medium.

According to this configuration, the liquid jet head in the present invention is provided, the liquid jet apparatus can be superior in reliability.

According to the present invention, the manufacturing process steps can be efficiently performed and simplified.

DETAILED DESCRIPTION

Figure 1:
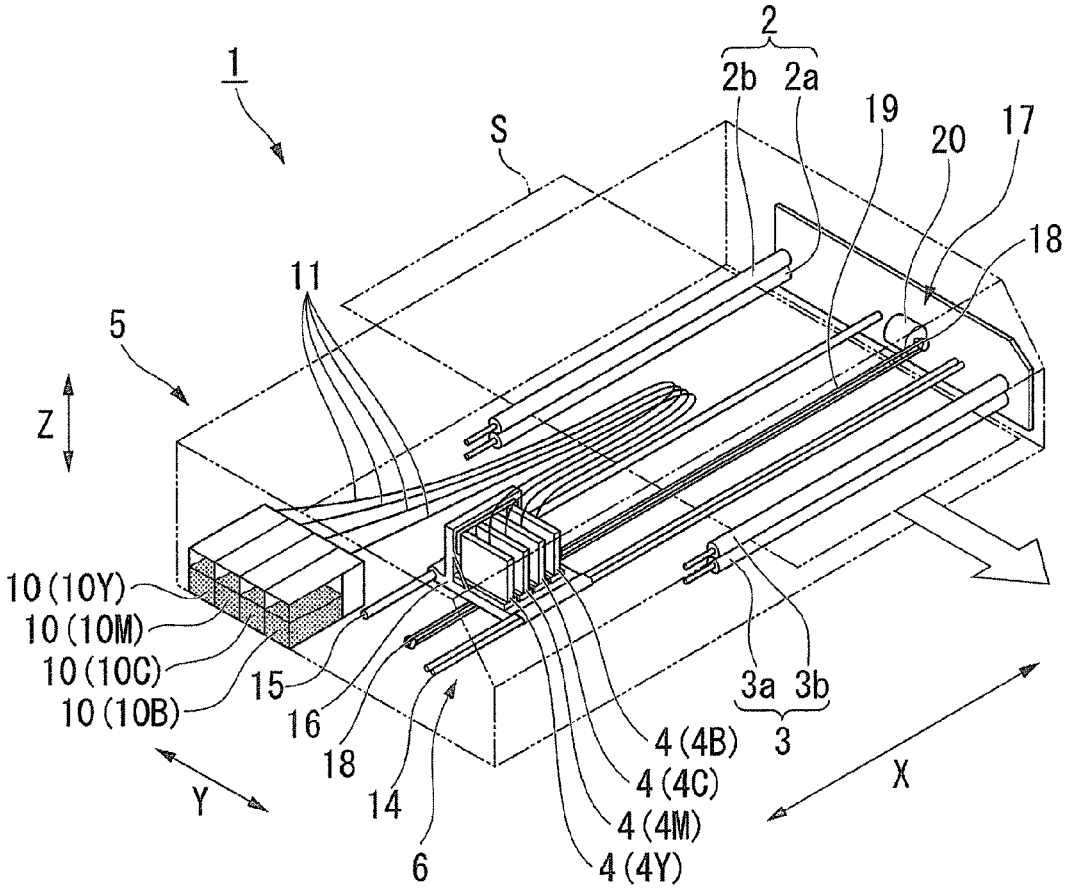
FIG. 1 is a perspective view of an ink jet printer in an embodiment.

Hereinafter, a first embodiment according to the present invention will be described with reference to the drawings. In the following embodiment, a description will be given to an ink jet printer (hereinafter, simply referred to as the printer) that prints onto a recording medium such as recording paper by using ink (liquid), as one example of a liquid jet apparatus including a liquid jet head in the present invention. In addition, in the drawing used for the description, a scale size of each member is occasionally changed so that the member can be easily recognized.

[Printer]

FIG. 1 is a perspective view of a printer 1.

As illustrated in FIG. 1, the printer 1 includes a pair of conveyance mechanisms 2 and 3 for conveying a recording medium S such as paper, ink jet heads 4 for injecting ink droplets to the recording medium S, an ink supply unit 5 for supplying ink to the ink jet heads 4, and a scan unit 6 for moving the ink jet heads 4 in a direction (sub scanning direction) perpendicular to a conveyance direction of the recording medium S (main scanning direction).

Furthermore, the description will be given on the assumption that the sub scanning direction extends in an X direction, the main scanning direction extends in a Y direction, and a direction perpendicular to the X direction and the Y direction extends in a Z direction. Here, the printer 1 is used after being set so that the X direction and the Y direction extend as a horizontal direction, and the Z direction extends as a vertical direction.

The pair of conveyance mechanisms 2 and 3 includes grid rollers 2*a* and 3*a* each extending in the X direction, pinch rollers 2*b* and 3*b* extending parallel to the grid rollers 2*a* and 3*a*, respectively, and a drive mechanism (not shown) such as a motor for rotating the grid rollers 2*a* and 3*a* around their axes.

The ink supply unit 5 includes a plurality of ink tanks 10 serving as ink containers, and ink pipes 11 for connecting the ink tanks 10 to the ink jet heads 4. The plurality of ink tanks 10 include ink tanks 10Y, 10M, 10C, and 10B that contain four kinds of ink of yellow, magenta, cyan, and black, respectively and are arranged in the Y direction. The ink pipe 11 is a flexible hose that can follow up an operation (movement) of a carriage 16 that supports the ink jet heads 4. In addition, the ink tanks 10 not only include the ink tanks 10Y, 10M, 10C, and 10B containing the four kinds of ink of yellow, magenta, cyan, and black, respectively, but also include an ink tank containing a multicolor ink.

The scan unit 6 includes a pair of guide rails 14 and 15 that extends in the X direction and is arranged parallel to each other with a space in the Y direction, the carriage 16 that is movable along the pair of guide rails 14 and 15, and a drive mechanism 17 that moves the carriage 16 in the X direction.

The drive mechanism 17 includes a pair of pulleys 18 arranged between the pair of guide rails 14 and 15 with a space in the X direction, an endless belt 19 wound around a pair of the pulleys 18 and moving in the X direction, and a drive motor 20 for rotating the one pulley 18.

The carriage 16 is connected to the endless belt 19, and movable in the X direction together with the endless belt 19 in response to the rotation drive of the one pulley 18. Furthermore, the carriage 16 mounts the plurality of ink jet heads 4 arranged in the X direction. In the illustrated example, the four ink jet heads 4 such as ink jet heads 4Y, 4M, 4C, and 4B are mounted on the carriage 16 to eject the ink of yellow (Y), magenta (M), cyan (C), and black (B), respectively. Thus, the conveyance mechanisms 2 and 3, and the scan unit 6 constitute a moving mechanism for relatively moving the ink jet heads 4 and the recording medium S.

(Ink Jet Head)

Figure 2:
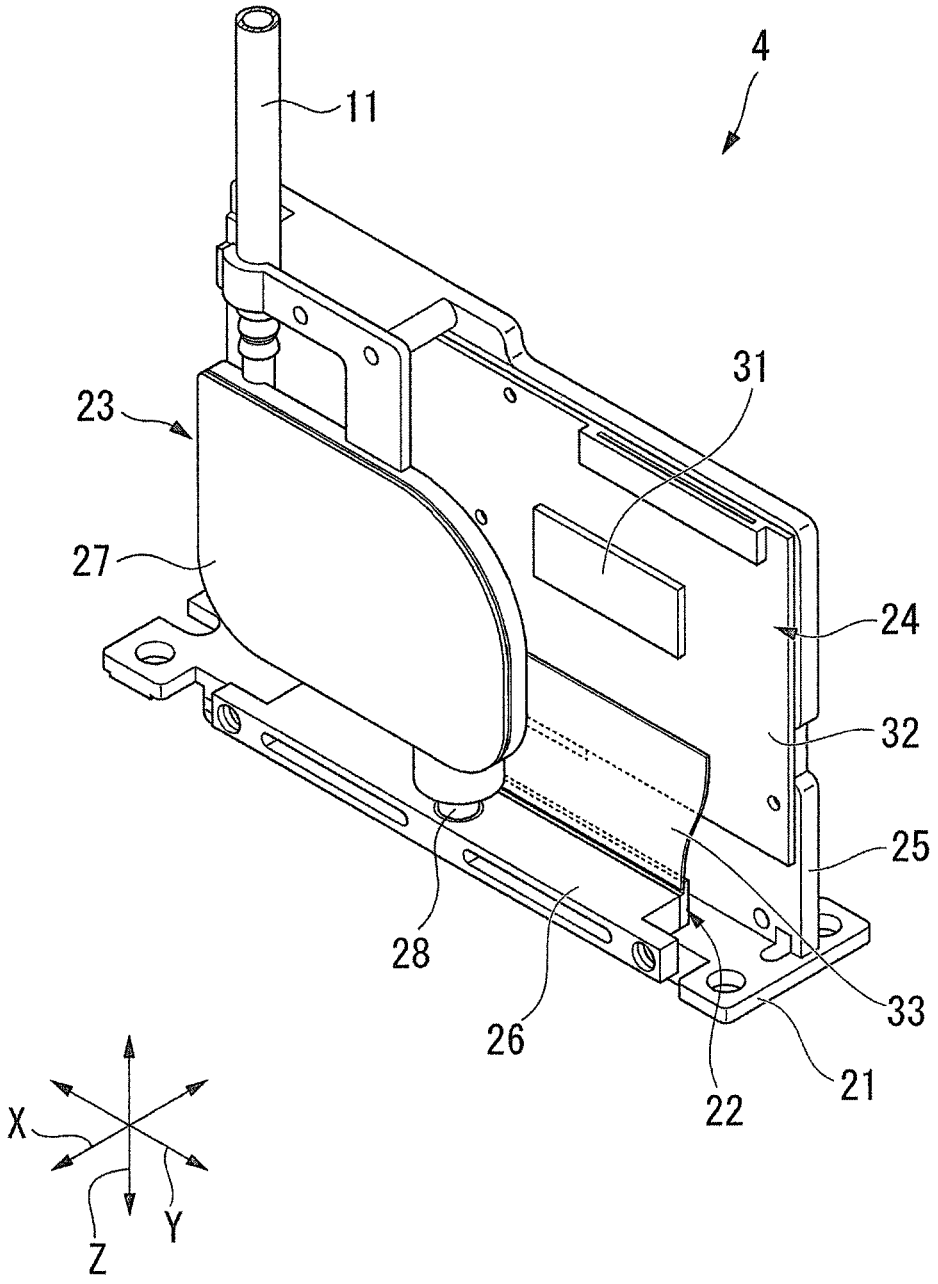
FIG. 2 is a perspective view of an ink jet head.

Next, the ink jet head 4 will be described in detail. FIG. 2 is a perspective view of the ink jet head 4. In addition, each ink jet head 4 has the same configuration except for the ink color to be supplied, so that the one ink jet head 4 will be described below.

As illustrated in FIG. 2, the ink jet head 4 includes a fixed plate 21 fixed to the carriage 16, a head chip 22 fixed on the fixed plate 21, an ink supply portion 23 for supplying the ink supplied from the ink supply unit 5 to a common ink chamber 71 (refer to FIG. 3) which will be described below, in the head chip 22, and a head drive portion 24 for applying a drive voltage to the head chip 22.

The ink jet head 4 ejects a predetermined amount of color ink when the drive voltage is applied. At this time, the ink jet head 4 is moved in the X direction by the scan unit 6, so that a predetermined range of the recording medium S can be printed. Thus, this scanning is repeated while the recording medium S is conveyed in the Y direction by the conveyance mechanisms 2 and 3, so that the entire region of the recording medium S can be printed.

A support plate 25 made of metal such as aluminum is fixed to the fixed plate 21 so as to stand in the Z direction, and a flow path member 26 is also fixed thereto. The flow path member 26 supplies the ink to the common ink chamber 71 which will be described below, in the head chip 22. A pressure buffer 27 incorporating a storage chamber for storing the ink is arranged above the flow path member 26 while being supported by the support plate 25. Thus, the flow path member 26 and the pressure buffer 27 are connected through an ink connection pipe 28, and the ink pipe 11 in the ink supply unit 5 is connected to the pressure buffer 27.

Thus, when the ink is supplied to the pressure buffer 27 through the ink pipe 11, the ink is stored in the storage chamber once, and then a predetermined amount of ink is supplied to the common ink chamber 71 through the ink connection pipe 28 and the flow path member 26.

Thus, the flow path member 26, the pressure buffer 27, and the ink connection pipe 28 constitute the ink supply portion 23.

Furthermore, an IC substrate 32 is mounted on the support plate 25. A control circuit (drive circuit) 31 such as an integrated circuit is mounted on the IC substrate 32 to drive the head chip 22. The control circuit 31 is electrically connected to drive electrodes (a common electrode 61, a common terminal 62, an individual electrode 63, and an individual terminal 64) which will be described below, in the head chip 22 through a flexible printed substrate 33. Thus, the control circuit 31 can apply the drive voltage to the drive electrodes 61 to 64 through the flexible printed substrate 33 on which a wiring pattern (not shown) is printed.

Thus, the IC substrate 32 mounting the control circuit 31, and the flexible printed substrate 33 constitute the head drive portion 24.

(Head Chip)

Figure 3:
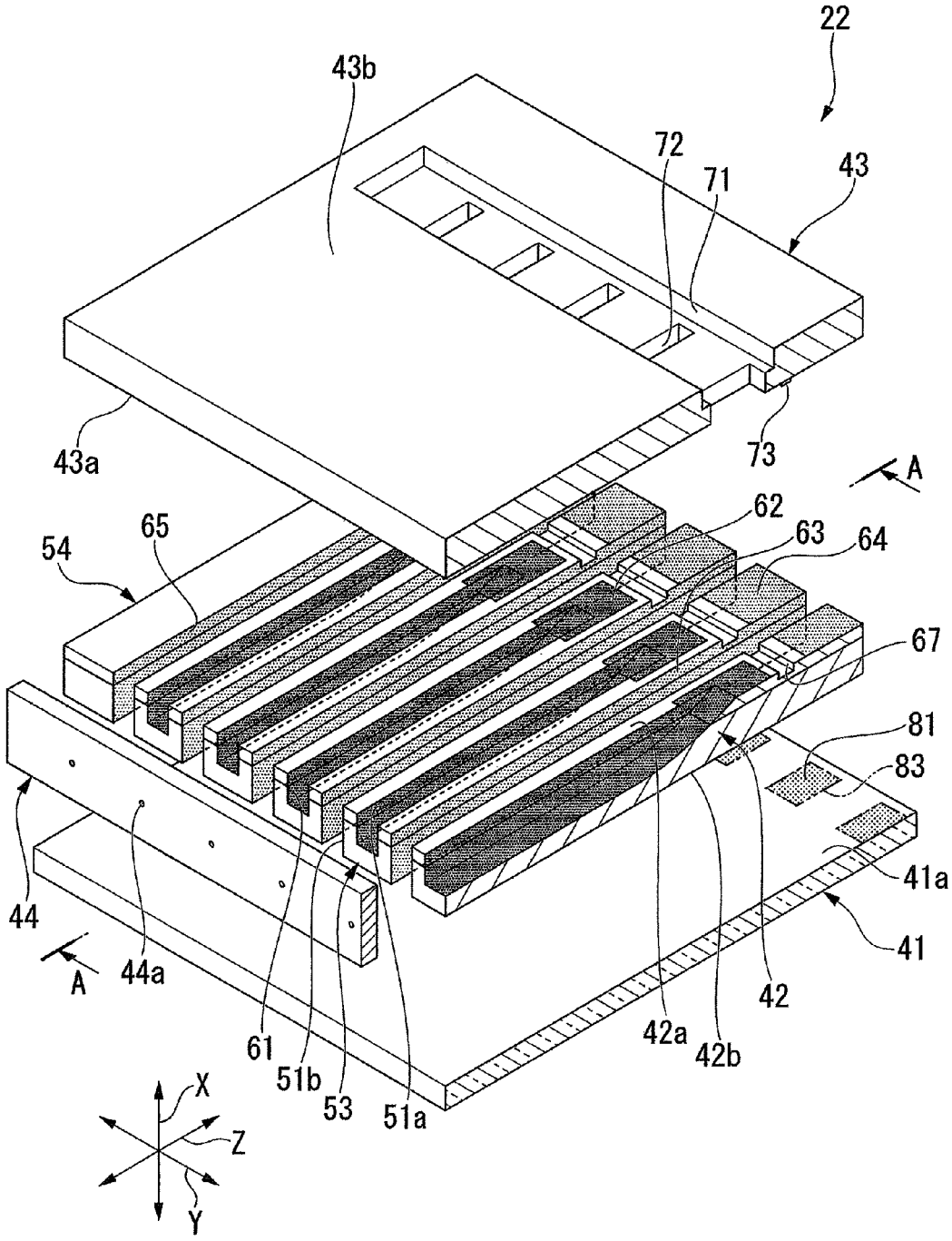
FIG. 3 is an exploded perspective view of a head chip taken from one side in a Z direction.
Figure 4:
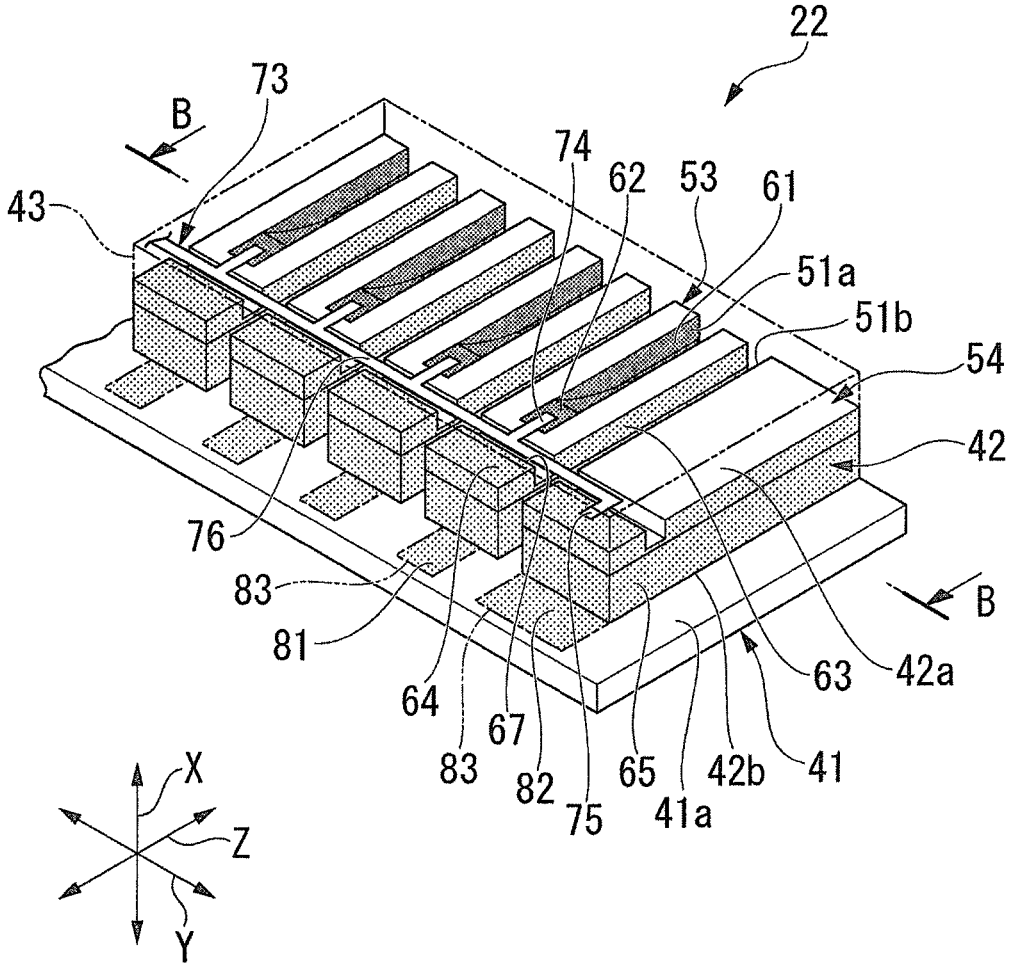
FIG. 4 is perspective view of the head chip taken from another side in the Z direction.

Next, the head chip 22 will be described in detail. FIG. 3 is an exploded perspective view of the head chip 22 taken from one side of the Z direction, and FIG. 4 is a perspective view of the head chip 22 taken from the other side of the Z direction. Furthermore, FIG. 5 is a cross-sectional view taken along a line A-A in FIG. 3.

Figure 5:
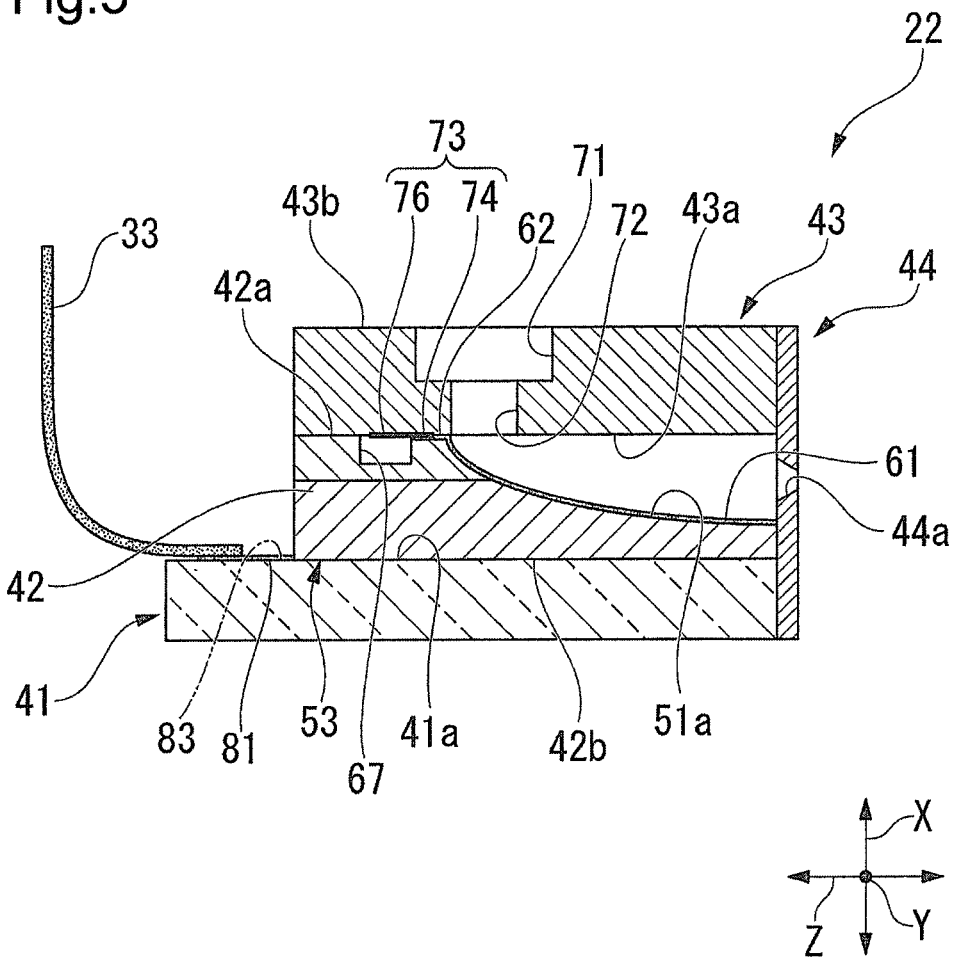
FIG. 5 is a cross-sectional view taken along a line A-A in FIG. 3.

As illustrated in FIGS. 3 to 5, the head chip 22 according to this embodiment includes a base plate 41, an actuator plate (actuator portion) 42, a cover plate 43, and a nozzle plate (jet hole plate) 44. Furthermore, the head chip 22 is an edge-shoot type in which the ink is ejected from an ejection channel (jet channel) 51*a* which will be described below. In addition, in the following description, a side (one side) of the nozzle plate 44 in the Z direction is referred to as a front side, and a side (the other side) opposite to the nozzle plate 44 is referred to as a rear side.

The base plate 41 is made of dielectric body such as glass.

The actuator plate 42 is provided as a laminated plate in which two plates each having a different polarization direction in a thickness direction (X direction) are laminated (chevron structure). Each of the two plates is a piezoelectric substrate polarized in the thickness direction (X direction) such as a piezoelectric zirconate titanate (PZT) ceramic substrate, and they are bonded with their polarization directions facing oppositely.

The actuator plate 42 is fixed to the base plate 41 by adhering under the condition that its front end coincides with a front end of the base plate 41. The actuator plate 42 is smaller in outer shape than the base plate 41 in a planar view taken from the X direction. Therefore, each side in the Y direction and a rear end of the base plate 41 project outward from the actuator plate 42.

The actuator plate 42 has the plurality of channels 51*a* and 51*b* which are recessed in the X direction and juxtaposed in the Y direction (juxtaposed direction) at predetermined intervals. Each of these channels 51*a* and 51*b* is open in a main surface 42*a* of the actuator plate 42, and linearly extends along the Z direction.

More specifically, the channels 51*a* and 51*b* are divided into ejection channels 51*a* filled with the ink, and dummy channels 51*b* not filled with the ink. Thus, the ejection channels 51*a* and the dummy channels 51b are alternately arranged in the Y direction.

The dummy channel 51b penetrates the actuator plate 42 in the X direction and the Z direction, and splits the actuator plate 42 in the Y direction. In addition, the actuator plate 42 is composed of center blocks (channel blocks) 53 located between the adjacent dummy channels 51b arranged in the Y direction, and a pair of outside blocks 54 located outside the dummy channels 51b disposed at outermost ends in the Y direction. In addition, the illustrated example only illustrates the one outside block 54 of the pair of outside blocks 54.

Meanwhile, the ejection channel 51*a* is formed in each of the center blocks 53 to be open in the actuator plate 42 in the X and Z directions. Therefore, each center block 53 has drive walls that constitute the ejection channel 51*a* on both sides of the ejection channel 51*a* in the Y direction. The drive wall having a rectangular cross-sectional shape extends in the Z direction, and the ejection channel 51*a* and the dummy channel 51*b* are separated by the drive walls. In addition, in the illustrated example, the ejection channel 51*a* becomes shallow as its rear end comes near the rear side.

The common electrode 61 is formed on inner surfaces of the ejection channel 51*a*, that is, a pair of side wall surfaces opposed to each other in the Y direction and a bottom wall surface. The common electrode 61 extends along the ejection channel 51*a* in the Z direction, and is connected to the common terminal 62 formed on the one main surface 42*a* of the center block 53. In addition, each common terminal 62 is patterned and formed so as to be electrically independent.

Meanwhile, the individual electrode 63 is formed on entire outer side surfaces of the center block 53 (a pair of side wall surfaces opposed in the Y direction among inner surfaces of the dummy channel 51*b*). The individual electrode 63 is connected to the individual terminal 64 (refer to FIG. 4) formed on the one main surface 42*a* and a rear end surface, in the rear end of the center block 53. Therefore, the pair of individual electrodes 63 formed on the outer side surfaces of the center block 53 is connected to each other through the individual terminal 64. In addition, the individual electrode 63 is not formed in a bottom wall surface (on base plate 41) among inner surfaces of the dummy channel 51*b*, so that the individual electrodes 63 formed on the pair of outer side surfaces opposed in the Y direction are separated by the bottom surface. Furthermore, the common electrode 61, the common terminal 62, the individual electrode 63, and the individual terminal 64 constitute the drive electrodes 61 to 64.

Furthermore, a ground terminal 65 is formed on outer wall surfaces of the outside block 54. In addition, in the illustrated example, the ground terminal 65 is formed on each of the one main surface 42*a*, the outer side surfaces, and a rear end surface of the outside block 54, but it only has to be formed on at least one main surface 42*a* and the rear end surface.

Furthermore, a groove portion 67 is formed in the one main surface 42a of the actuator plate 42 (including the center block 53 and the outside block 54) so as to extend in the Y direction and to be located between the common terminal 62 and the individual terminal 64. The groove portion 67 is dented (recessed) in the Z direction, and located between the common terminal 62 and the individual terminal 64.

A main surface 43*a* of the cover plate 43 is bonded to the one main surface 42*a* of the actuator plate 42. In addition, if a rear end side of the actuator plate 42 is exposed, the rear end side of the actuator plate 42 could be cracked or damaged, and the individual terminal 64 could be broken in a case where the head chip 22 collides with a jig or the like used in the manufacturing process. In order to eliminate this problem, the cover plate 43 has the same shape as that of the actuator plate 42 in a Z-Y plane, so that a planar outline of the cover plate 43 taken from the X direction coincides with a planar outline of the actuator plate 42 (including the center block 53 and the outside block 54) taken from the X direction. That is, the cover plate 43 covers the rear end side of the actuator plate 42 in the Z-Y plane. In addition, the cover plate 43 includes the recessed common ink chamber (liquid chamber) 71 formed in another main surface 43*b*, and a plurality of slits 72 to connect the common ink chamber 71 to the ejection channels 51*a* respectively.

The common ink chamber 71 is a rectangular opening located in a rear end of the cover plate 43, dented toward the actuator plate 42 in the X direction, and extending in the Y direction. The common ink chamber 71 is connected to the inside of the flow path member 26 (refer to FIG. 2) so that the ink in the flow path member 26 is distributed thereto.

The slit 72 is formed in the common ink chamber 71 so as to correspond to the ejection channel 51*a*. More specifically, the slit 72 has a predetermined length in the Z direction, and a rear edge of the slit 72 coincides with a rear edge of the ejection channel 51*a* (an end point of an envelope shape of the ejection channel 51*a*) in the Z direction (refer to FIG. 5). In this configuration, the ink in the common ink chamber 71 is introduced into the ejection channel 51*a*, and is prevented from being introduced into the dummy channel 51*b*. Furthermore, due to the above specific arrangement of the slits 72, the ink does not stagnate in the ejection channel 51*a* on the rear end side, so that air bubbles are prevented from remaining in the ejection channel 51*a*.

A connection wiring 73 is formed on the one main surface 43*a* of the cover plate 43, to connect the common terminals 62 to the ground terminals 65. More specifically, the connection wiring 73 includes a common connection portion 74 connected to each of the common terminals 62, a ground connection portion 75 (refer to FIG. 4) connected to each of the ground terminals 65, and a main wiring 76 to connect the common connection portion 74 and the ground connection portion 75.

The main wiring 76 is formed into a strip shape extending in the Y direction in the cover plate 43 so as to be opposed to the groove portion 67 in the actuator plate 42 in the X direction. Thus, the main wiring 76 is formed over an entire length of the cover plate 43 in the Y direction to stride over the pair of outside blocks 54 in the actuator plate 42. Furthermore, the connection wiring 73 has a width (width in the Z direction) smaller than a width of the groove portion 67 so as to be away from the actuator plate 42.

The common connection portions 74 are arranged at intervals in the Y direction, and extend parallel to each other in the Z direction. In this case, an arrangement pitch of the common connection portions 74 in the Y direction is equal to an arrangement pitch of the ejection channels 51*a*. Thus, as for the common connection portions 74, while their front ends are connected to the corresponding common terminals 62, their rear ends are collectively connected to the main wiring 76.

The ground connection portion 75 extends from each end of the main wiring 76 in the Y direction to the rear side, and its rear end is connected to the corresponding ground terminal 65 formed on the one main surface 42*a* of the outside block 54.

Here, extracting electrodes (an individual extracting electrode 81 and a ground extracting electrode 82) to which each of the individual terminal 64 and the grand terminal 54 is connected individually are formed on the rear side of one main surface 41*a* of the base plate 41 to be located on the rear side of the actuator plate 42.

The individual extracting electrodes 81 are arranged at intervals in the Y direction, and extend parallel to each other in the Z direction. In this ease, an arrangement pitch of the individual extracting electrodes 81 in the Y direction is equal to an arrangement pitch of the center blocks 53. Thus, a front end of the individual extracting electrode 81 is connected to the corresponding individual terminal 64, and a rear end thereof is led to a position closer to a rear edge of the base plate 41.

As for the ground extracting electrode 82, its front end is connected to the corresponding ground terminal 65, and its rear end is led to a position close to the rear edge of the base plate 41.

In addition, an area of the ground extracting electrode 82 is larger than an area of the individual extracting electrode 81. For example, as illustrated in FIG. 4, a length of the ground extracting electrode 82 is equal to that of the individual extracting electrode 81 in the Z direction, and a length of the ground extracting electrode 82 is longer than that of the individual extracting electrode 81 in the Y direction.

Thus, as illustrated in FIG. 5, the flexible printed substrate 33 is connected to the rear end of the base plate 41, and a wiring pattern (not shown) formed on the flexible printed substrate 33 is connected to each of the extracting electrodes 81 and 82.

Figure 8A:
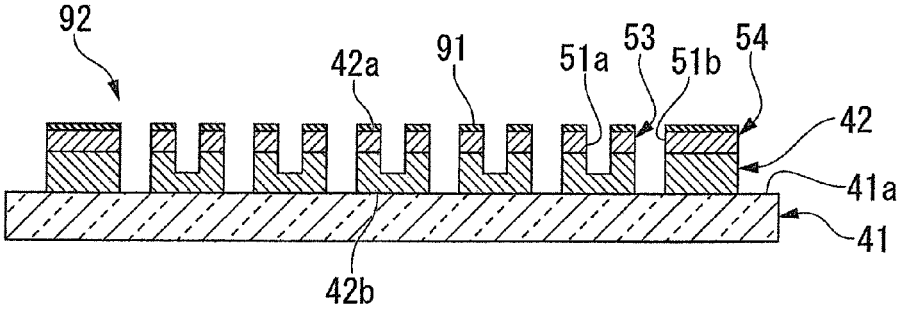
FIGS. 8A to 8C are views to describe the method for manufacturing the ink jet head, and cross-sectional views taken along the line B-B in FIG. 4.
Figure 8B:
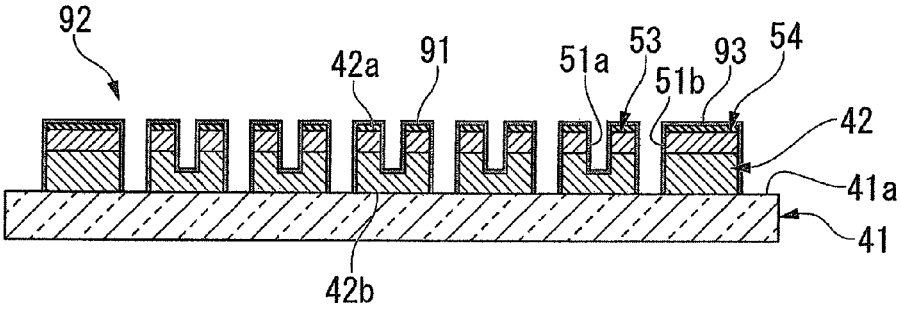
Figure 8C:
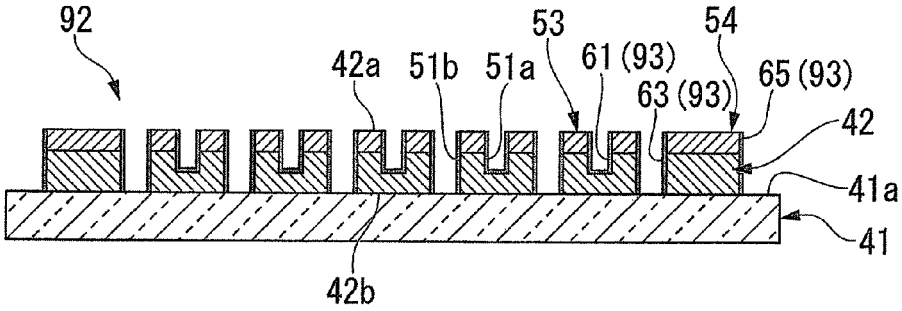

Meanwhile, as illustrated in FIG. 4, the drive electrodes 61 to 64, the ground terminal 65, and the extracting electrodes 81 and 82 are integrally formed with a plated film 93 formed of Ni/Au (refer to FIG. 8C). Here, an anchor portion 83 is provided in an electrode formation region where the extracting electrodes 81 and 82 are formed on the one main surface 41*a* of the base plate 41, and its surface roughness Ra is greater than that of a region (non-formation region) other than the electrode formation region. In this case, the surface roughness Ra of the anchor portion 83 (electrode formation region) is to be great enough so that the plated film 93 can be formed, that is, it is desirably 400 Å or more. Meanwhile, the surface roughness Ra of the non-formation region is set so that the plated film 93 cannot be formed, that is, it is desirably less than 100 Å. That is, according to this embodiment, the surface roughness Ra of the anchor portion 83 is desirably equal to or more than four times as great as the surface roughness Ra of the non-formation region. Furthermore, according to this embodiment, the surface roughness Ra is a numerical value of the arithmetic mean roughness Ra standardized by JIS B0601.

The non-formation region in this embodiment includes the bottom surface of the dummy channel 51*b*, that is, a portion located between the center blocks 53, in the one main surface 41*a* of the base plate 41.

Meanwhile, as for the anchor portion 83 according to this embodiment, its width in the Y direction is set to be equal or less than the widths of the center block 53 and the outside block 54. According to the illustrated example, the width of the anchor portion 83 corresponding to the center block 53 is less than the width of the center block 53, and the width of the anchor portion 83 corresponding to the outside block 54 is equal to the width of the outside block 54.

Furthermore, as for the anchor portion 83, its size can be appropriately changed in design as long as it is formed in the electrode formation region (within a range of the same shape and size of each of the extracting electrodes 81 and 82) and the adjacent anchor portions 83 in the Y direction are separated from each other. For example, a front end of the anchor portion 83 may be ahead of the rear end of the actuator plate 42, on the base plate 41 and reach a position overlapping with the blocks 53 and 54 in the X direction.

As illustrated in FIGS. 3 and 5, the nozzle plate 44 is a film-shaped plate composed of resin material such as polyimide, and it is adhered and fixed to the front ends of the base plate 41, the actuator plate 42, and the cover plate 43.

Furthermore, the nozzle plate 44 has a plurality of nozzle holes 44*a* which penetrate in the Z direction and are arranged in the Y direction at predetermined intervals. These nozzle holes 44*a* are formed so as to be opposed to the ejection channels 51*a* and to communicate with the ejection channels 51*a*, respectively.

<Method for Operating Ink Jet Head>

Next, a method for operating the ink jet head 4 will be described.

When the drive voltage is applied to the drive electrodes 61 to 64 through the flexible printed substrate 33 in the ink jet head 4, the two drive walls in the ejection channel 51*a* are deformed and protrude toward the dummy channel 51*b* due to a piezoelectric slide effect. That is, the actuator plate 42 in this embodiment is provided by laminating the two plates which have been polarized in the thickness direction (X direction), so that when the drive voltage is applied, the drive wall is bent and deformed into a V-shaped configuration from a center position of the drive wall in the X direction. Thus, the ejection channel 51*a* is deformed as if it is swollen.

When the volume of the ejection channel 51*a* is increased due to the deformation of the two drive walls, the ink in the common ink chamber 71 is introduced into the ejection channel 51*a* through the slit 72. Thus, the ink introduced into the ejection channel 51*a* moves through the ejection channel 51*a* as a pressure wave. The moment the pressure wave reaches the nozzle hole 44*a*, the drive voltage applied to the drive electrodes 61 to 64 are set to zero.

Accordingly, the drive walls are restored, and the increased volume of the ejection channel 51*a* returns to the original volume. By this behavior, the pressure in the ejection channel 51*a* is increased and the ink is pressurized. As a result, the ink can be ejected from the nozzle hole 44*a*. Here, when the ink passes through the nozzle hole 44*a*, the ink is ejected as liquid ink droplets.

The method for operating the ink jet head 4 is not limited to the above. For example, the drive wall in a normal state may be deformed toward the inner side of the ejection channel 51*a*, and the ejection channel 51*a* may be configured as if it is bent to the inner side. This configuration can be implemented by setting the plus and the minus of the voltage opposite to the above voltage which is to be applied to the drive electrodes 61 to 64, or reversing the polarized directions of the piezoelectric elements of the actuator plate 42 when the plus and minus of the voltage is not changed. In addition, as still another configuration, after the ejection channel 51*a* has been deformed and swollen to the outer side, the ejection channel 51*a* is bent to the inner side to further increase the pressure force when the ink is ejected.

Furthermore, according to the ink jet head 4 in this embodiment, the dummy channel 51*b* to which the ink is not supplied is provided between the ejection channels 51*a*, so that the ink can be ejected from all of the ejection channels 51*a* at the same time (that is, one-cycle method). Furthermore, because the dummy channels 51*b* are arranged in this manner, the drive electrodes 61 to 64 do not cause a short circuit through the ink. As a result, various kinds of ink including conductive ink such as water-based ink can be used, and convenience is enhanced.

<Method for Manufacturing Ink Jet Head>

Figure 6:
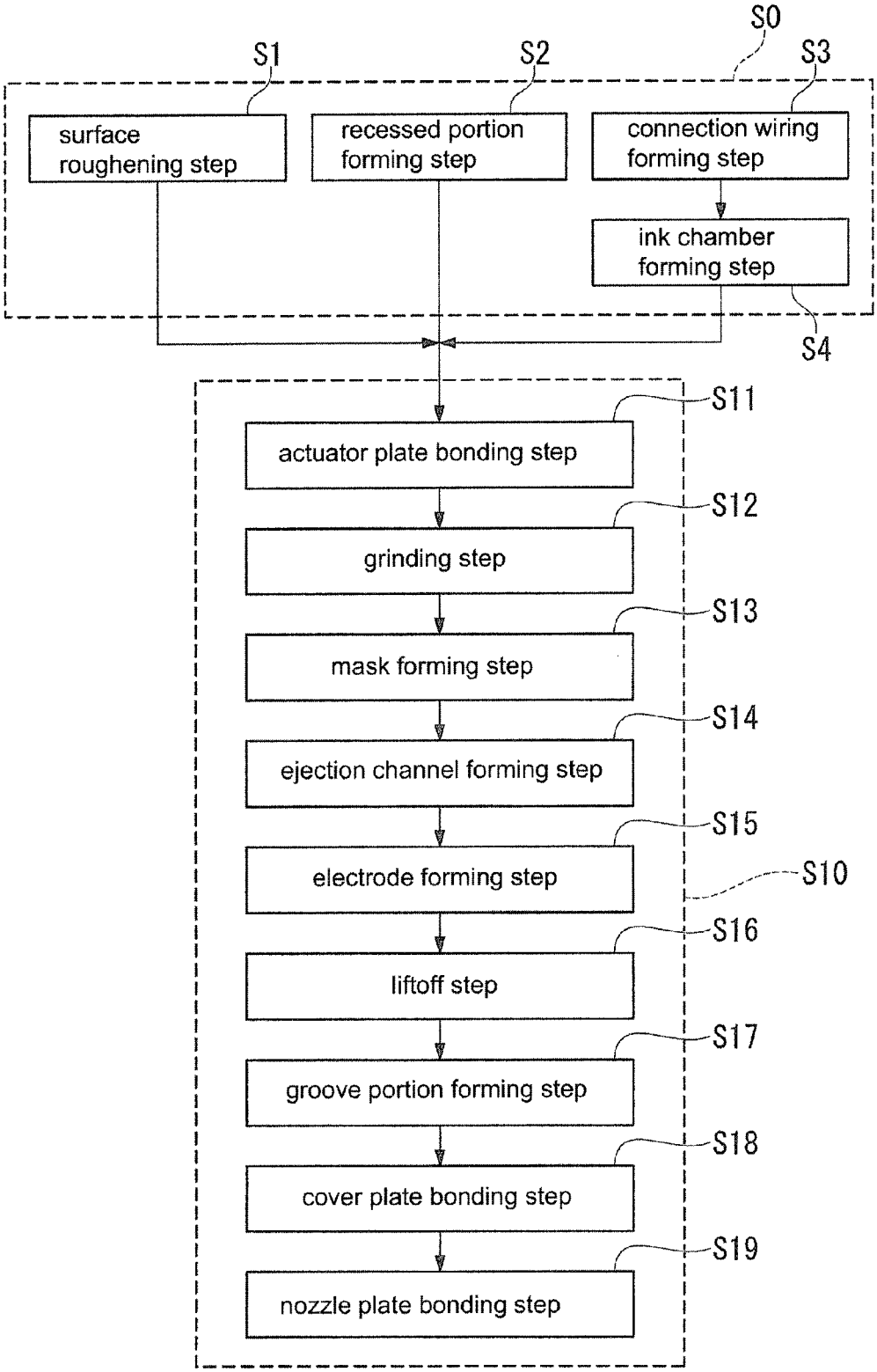
FIG. 6 is a flowchart to describe a method for manufacturing the ink jet head.

Next, a method for manufacturing the ink jet head 4 will be described. FIGS. 6 to 8C are views to describe the method for manufacturing the ink jet head 4, in which FIG. 6 is a flowchart, and FIGS. 7A to BC are cross-sectional views taken along a line B-B in FIG. 4.

As illustrated in FIGS. 6 and 7A to 7D, the method for manufacturing the ink jet head 4 according to the embodiment mainly includes preparation steps (S0) performed before the bonding of the base plate 41, the actuator plate 42, and the cover plate 43, and assembly steps (S10) performed while the actuator plate 42 and the cover plate 43 are bonded to the base plate 41. In addition, the preparation steps (S0) for the base plate 41, the actuator plate 42, and the cover plate 43 can be performed in parallel.

(Preparation Steps)

Figure 9:
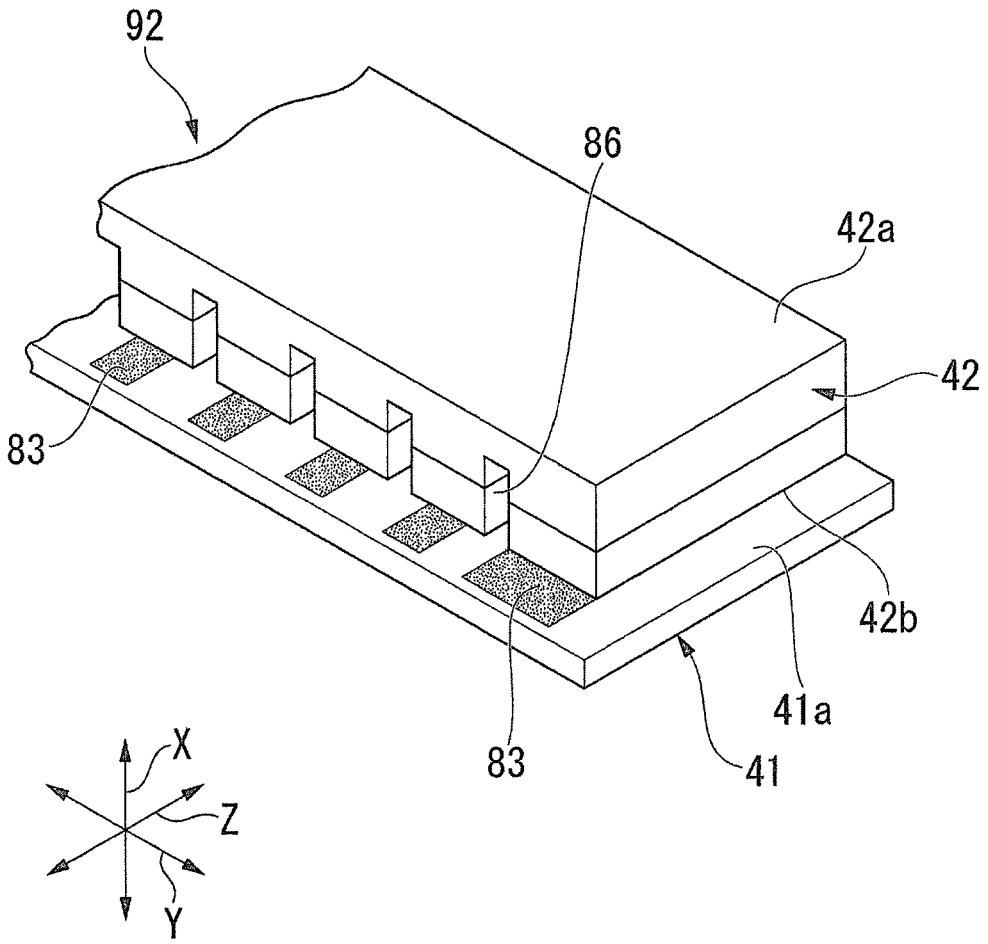
FIG. 9 is a view to describe the method for manufacturing the ink jet head, and a perspective view corresponding to FIG. 4.

FIG. 9 is a perspective view to describe the method for manufacturing the ink jet head 4 and corresponds to FIG. 4.

First, as illustrated in FIGS. 6 and 9, in the preparation step for the base plate 41, the anchor portion 83 is formed on the one main surface 41*a* of the base plate 41 (S1: surface roughening step). More specifically, the region for the anchor portion 83 (electrode formation region) on the one main surface 41*a* of the base plate 41 is subjected to a sandblasting process to obtain the surface roughness Ra so that the plated film 93 can be formed. In addition, in the surface roughening step (S1), the surface of the base plate 41 may be roughened by etching or using laser instead of the sandblasting process.

Figure 7A:
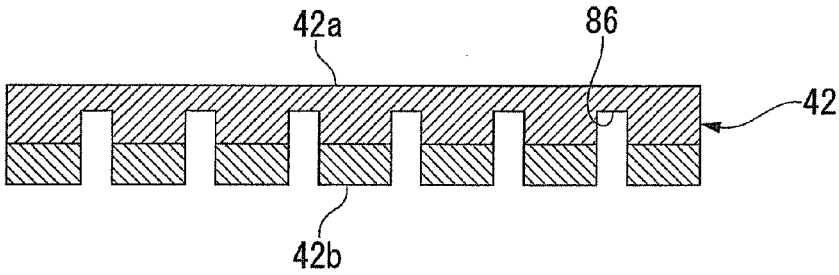
FIGS. 7A to 7D are views to describe the method for manufacturing the ink jet head, and cross-sectional views taken along a line B-B in FIG. 4.

In addition, as illustrated in FIGS. 6 and 7A, in the preparation step for the actuator plate 42, recessed portions 86 which will become the dummy channels 51*b* are formed in the other main surface 42*b* of the actuator plate 42 (S2: recessed portion forming step). More specifically, the recessed portions 86 are formed through a grinding process such as dicing, so that they linearly extend in the Z direction, and are spaced at intervals in the Y direction. In addition, the recessed portion 86 is formed to be open in both ends of the actuator plate 42 in the Z direction. Furthermore, a depth of the recessed portion 86 in the X direction corresponds to heights of the center block 53 and the outside block 54 in the X direction.

Furthermore, as illustrated in FIG. 6, in the preparation step for the cover plate 43, the connection wiring 73 (refer to FIG. 4) is formed on the one main surface 43*a* of the cover plate 43 by film forming method such as vapor evaporation or plating, with a mask (not shown) interposed (S3: connection wiring forming step).

Then, the cover plate 43 is subjected to the sandblasting process, whereby the common ink chamber 71 and the slits 72 are formed in the cover plate 43 (S4: ink chamber forming step).

(Assembly Steps)

Figure 7B:
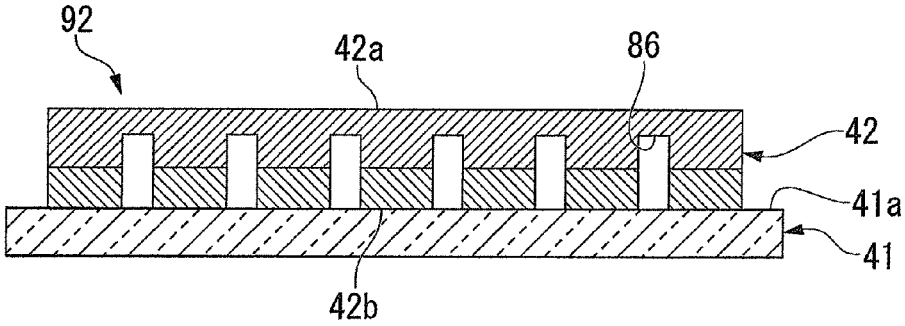

In the assembly steps (S10), as illustrated in FIGS. 7B and 9, the base plate 41 and the actuator plate 42 are adhered together (S11: actuator plate bonding step (bonding step)). At this time, the plates 41 and 42 are aligned so that the rear end of the actuator plate 42 coincides with the front edge of the anchor portion 83 in the base plate 41 in the Z direction, and then both plates 41 and 42 are adhered together with an adhesive agent. In addition, both of the plates 41 and 42 are to be aligned so that the rear end of the actuator plate 42 is not separated from the front edge of the anchor portion 83 in the base plate 41 in the Z direction. That is, both of the plates 41 and 42 may be aligned so that the rear end of the actuator plate 42 overlaps with the front edge of the anchor portion 83 in the base plate 41 in the Z direction.

Figure 10:
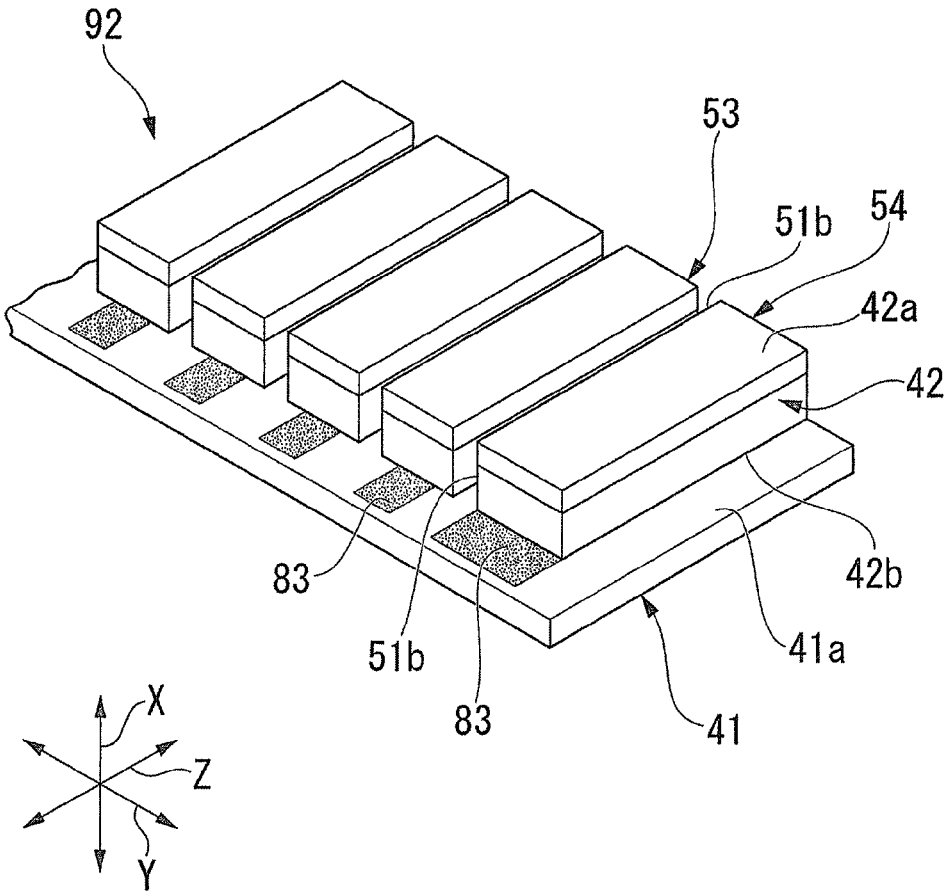
FIG. 10 is a view to describe the method for manufacturing the ink jet head, and a perspective view corresponding to FIG. 4.

FIG. 10 is a perspective view to describe the method for manufacturing the ink jet head 4 and corresponds to FIG. 4.

Figure 7C:
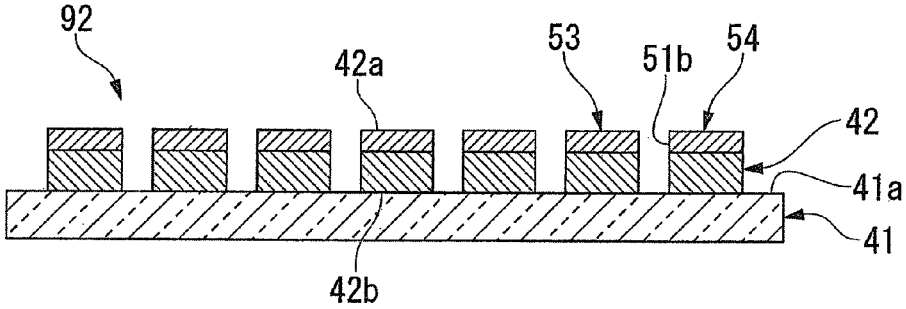

Subsequently, as illustrated in FIGS. 7C and 10, the one main surface 42*a* of the actuator plate 42 is ground with a grinder to open the recessed portions 86 (S12: grinding step). Thus, the actuator plate 42 is cut into the center blocks 53 and the outside blocks 54, and the dummy channels 51*b* are formed between the center blocks 53, and between the center block 53 and the outside block 54. Furthermore, according to this embodiment, the main surface on the one side of the actuator plate 42 in the X direction serves as the one main surface 42*a* in any state.

Figure 7D:
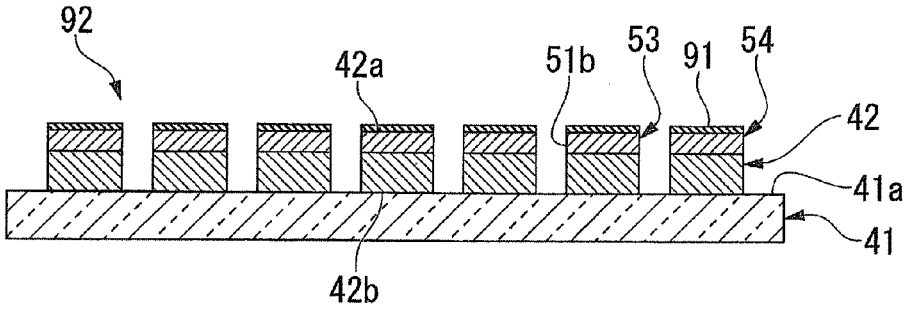

Subsequently, as shown in FIG. 7D, a mask 91 is formed on the surface of the actuator plate 42 (the center blocks 53 and the outside blocks 54) except for the formation regions of the drive electrodes 61 to 64, and the ground terminal 65 (S13: mask forming step). More specifically, a mask material such as a photosensitive dry film is applied onto the one main surface 42*a* of the actuator plate 42. Then, the mask material is patterned by photolithography technique, whereby the mask material in the portion corresponding to the formation regions of the terminals 62 and 64 is removed.

Subsequently, as shown in FIG. 8A, the one main surface 42*a* of the center block 53 is ground by dicing, whereby the ejection channels 51*a* are formed (S14: ejection channel forming step). In addition, according to this embodiment, the description has been given to the case where the ejection channel forming step (S14) is performed after the mask forming step (S13), but instead of this, the mask forming step (S13) may be performed after the ejection channel forming step (S14). However, the mask forming step (S13) is desirably performed first because an alignment mark to be used in the ejection channel forming step (S14) can be collectively provided with respect to the mask 91.

Subsequently, the drive electrodes 61 to 64, the ground terminal 65, and the extracting electrodes 81 and 82 are formed in a bonded body 92 of the actuator plate 42 and the base plate 41 (S15: electrode forming step). According to this embodiment, the electrode forming step (S15) is performed by electroless plating.

In the electrode forming step, a catalyst is applied to the formation regions of the drive electrodes 61 to 64, the ground terminal 65, and the extracting electrodes 81 and 82, in the bonded body 92. More specifically, the bonded body 92 is soaked in a stannous chloride solution, and a sensitizing process is performed so that the surface of the bonded body 92 adsorbs the stannous chloride.

Then, the bonded body 92 is lightly cleaned with water. After that, the bonded body 92 is soaked in a palladium chloride solution so that the surface of the bonded body 92 adsorbs palladium chloride. Thus, a redox reaction is developed between the palladium chloride adsorbed on the surface of the bonded body 92, and stannous chloride adsorbed in the sensitizing process, so that metal palladium is precipitated as the catalyst (activating process).

Here, according to this embodiment, the catalyst is also applied to the anchor portion 83 in the base plate 41 due to the anchor effect, in addition to the entire surface of the actuator plate 42 in the bonded body 92. Meanwhile, the catalyst is not applied to the region (non-formation region) other than the anchor portion 83 in the base plate 41 because the surface roughness Ra is small.

Subsequently, as illustrated in FIG. 8B, the bonded body 92 to which the catalyst (metal palladium) has been applied is soaked in a plating solution, whereby the plated film 93 is precipitated in the portion to which the catalyst has been applied, in the bonded body 92.

Figure 11:
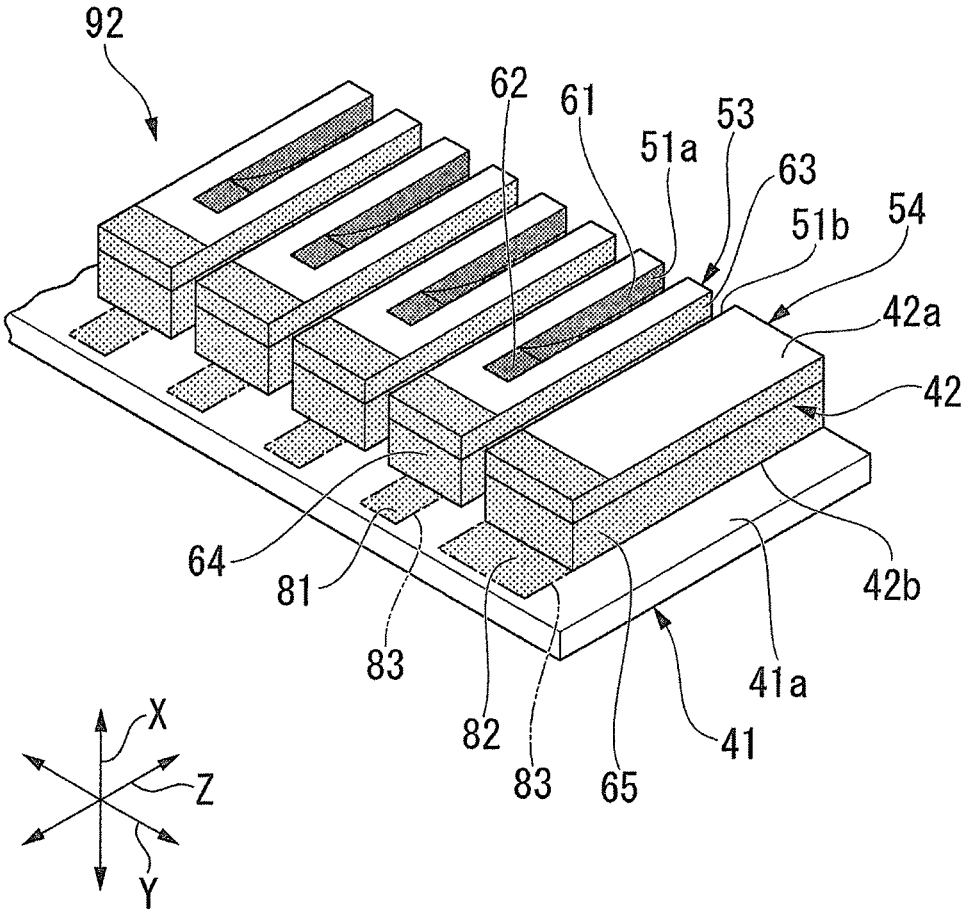
FIG. 11 is a view to describe the method for manufacturing the ink jet head, and a perspective view corresponding to FIG. 4.

FIG. 11 is a perspective view to describe the method for manufacturing the ink jet head 4 and corresponds to FIG. 4.

Subsequently, as illustrated in FIGS. 8C and 11, the mask 91 formed on the one main surface 42*a* of the actuator plate 42 is removed (S16: liftoff step). Thus, the drive electrodes 61 to 64, the ground terminal 65, and the extracting electrodes 81 and 82 are collectively formed on the bonded body 92.

Then, the groove portion 67 (refer to FIG. 4) is formed in the one main surface 42*a* of the actuator plate 42 (S17: groove portion forming step). More specifically, the groove portion 67 is formed in the one main surface 42*a* of the actuator plate 42 through a grinding process such as dicing so that the groove portion 67 extends in the Y direction through the space between the common terminal 62 and the individual terminal 64. Furthermore, the description has been given to the case where the groove portion 67 is formed in the entire actuator plate 42 (the center blocks 53 and the outside blocks 54) in the Y direction, but it may only have to be formed in the center blocks 53.

Subsequently, the cover plate 43 is bonded to the one main surface 42*a* of the actuator plate 42 (S18: cover plate bonding step). More specifically, both of the plates 42 and 43 are aligned so that the ejection channel 51*a* in the actuator plate 42 can communicate with the slit 72 in the cover plate 43. Furthermore, according to this embodiment, both of the plates 42 and 43 are aligned so that the main wiring 76 of the connection wiring 73 overlaps with the groove portion 67 in the X direction, and the common connection portion 74 and the ground connection portion 75 are connected to the corresponding common terminal 62 and the ground terminal 65, respectively. Thus, after the alignment, both of the plates 42 and 43 are bonded with the adhesive agent.

In addition, according to this embodiment, as described above, the outline of the cover plate 43 in the planar view taken from the X direction coincides with the outline of the entire actuator plate 42 in the planar view taken from the X direction, so that the above-described various kinds of alignments can be automatically completed only by aligning the ends of the plates 42 and 43.

After that, the nozzle plate 44 is bonded to the front ends of the base plate 41, the actuator plate 42, and the cover plate 43 (S19: nozzle plate bonding step).

Finally, the flexible printed substrate 33 is connected to the base plate 41. Thus, the wiring pattern of the flexible printed substrate 33 is electrically connected to each of the extracting electrodes 81 and 82 in the base plate 41.

Thus, when the head chip 22 configured as above is mounted on the carriage 16, the ink jet head 4 according to this embodiment is manufactured.

As described above, according to this embodiment, the anchor portion 83 having the surface roughness Ra greater than that of the non-formation region is formed in the electrode formation region where the extracting electrodes 81 and 82 are to be formed, in the base plate 41.

According to this configuration, the anchor effect can be provided in the electrode formation region in the base plate 41. That is, in the electrode forming step (S15), the plated film 93 can be precipitated only in the electrode formation region while the plated film 93 is not precipitated in the non-formation region, in the base plate 41. Consequently, the plated film 93 can be selectively formed in the desired region in the base plate 41. In this case, after the base plate 41 and the actuator plate 42 have been bonded, the drive electrodes 61 to 64, the ground terminal 65, and the extracting electrodes 81 and 82 can be collectively formed in the base plate 41 and the actuator plate 42 with the plated film 93. As a result, the manufacturing process steps can be performed efficiently and simplified compared with the case where the extracting electrodes 81 and 82, and the drive electrodes 61 to 64 and the ground terminal 65 are separately formed in the base plate 41 and the actuator plate 42, respectively.

Furthermore, according to this embodiment, the non-formation region includes the portion located between the center blocks 53 in the one main surface 41*a* of the base plate 41, so that the plated film 93 is not precipitated in the portion serving as the bottom surface of the dummy channel 51*b* in the base plate 41. Therefore, in the case where the individual electrode 63 is formed by plating, the plated film 93 can be precipitated only in the side wall surfaces (opposed surfaces of the center blocks 53) while the plated film 93 is not precipitated in the bottom surface, among the inner surfaces of the dummy channel 51*b*. Thus, it is not necessary to remove the plated film 93 precipitated on the bottom surface of the dummy channel 51*b* with laser in a subsequent process, so that manufacturing cost can be reduced, and dust to be generated in the subsequent process can be eliminated. Furthermore, the individual electrodes 63 formed on the side wall surfaces of the dummy channel 51*b* can be surely prevented from causing the short circuit through the bottom surface.

Furthermore, since the surface roughness Ra of the anchor portion 83 is set to 400 Å or more, the anchor portion 83 achieves the sufficient anchor effect, so that the plated film 93 having the enough thickness can be evenly formed in the electrode forming step (S15).

In addition, since the base plate 41 is composed of the glass material, the surface roughness Ra in the non-formation region can be low. In this case, since the plated film 93 can be prevented from being formed in the non-formation region, a patterning step is not needed after the plated film 93 has been formed, so that the manufacturing process steps can be efficiently performed, and the manufacturing cost can be reduced.

In addition, according to this embodiment, the common electrode 61 (common terminal 62) is connected to the ground terminal 65 through the connection wiring 73 formed on the cover plate 43, so that the common electrode 61 can be connected to the ground terminal 65 only by bonding the cover plate 43 to the actuator plate 42. Thus, the manufacturing process steps can be more efficiently performed.

Furthermore, according to this embodiment, the connection wiring 73 is arranged in the position corresponding to the groove portion 67 formed in the one main surface 42*a* of the actuator plate 42, so that the connection wiring 73 is prevented from coming into contact with the common terminal 62 and the individual terminal 64, and the short circuit can be prevented from being caused between the common terminal 62 and the individual terminal 64 through the connection wiring 73. Thus, the ink jet head 4 can be superior in reliability.

Thus, since the printer 1 according to this embodiment is provided with the above ink jet head 4, the printer 1 can be superior in reliability.

In addition, the technical range of the present invention is not limited to the above embodiment, and various modifications can be added without departing from the scope of the present invention.

For example, according to the above embodiment, the description has been given to the case of the ink jet printer 1 as one example of the liquid jet apparatus, but the liquid jet apparatus is not limited to the printer. The liquid jet apparatus may be a fax machine or an on-demand printer.

Furthermore, in the above embodiment, the description has been given to the multicolor printer 1 having the plurality of ink jet heads 4, but the present invention is not limited to this. The printer may be the single-color printer 1 having one ink jet head 4.

Furthermore, the usable ink in the embodiment of the present invention includes various kinds of ink such as water-based ink, oil-based ink, UV ink, fine metal particle ink, carbon ink (such as carbon black, carbon nanotube, fullerene, of graphene). In addition, among the above ink, the water-based ink, the oil-based ink, and the UV ink are favorably used in the multicolor printer 1, and the fine metal particle ink and the carbon ink are favorably used in the single-color printer 1.

In addition, in the above embodiment, the description has been given to the case where the base plate 41 is composed of glass, but the present invention is not limited to this. The base plate 41 may be composed of any material such as ceramic material as long as the material can have the surface roughness Ra which is small enough (such as about 100 Å) in the non-formation region so that the plated film 93 cannot be formed.

Furthermore, in the above embodiment, the description has been given to the case where the extracting electrodes 81 and 82 are linearly formed in the Z direction, but the present invention is not limited to this. The extracting electrodes 81 and 82 may extend outwardly in the Y direction as they get close to the rear end.

According to this configuration, the distance between the extracting electrodes 81 and 82 is increased as they get close to the rear side, so that the short circuit is prevented from being caused between the extracting electrodes 81 and 82, and electric reliability can be assured. Furthermore, the electrode pattern can be prevented from becoming complicated.

Furthermore, in the case where the extracting electrodes 81 and 82 extend outwardly in the Y direction as they get close to the rear side, the widths of the extracting electrodes 81 and 82 can be increased. For example, a specific shape of each of the extracting electrodes 81 and 82 may be a fan-like shape or trapezoidal shape. That is, any shape can be used as long as it is a folding-fan shape in which the width is increased in the Y direction as it moves in the Z direction.

The component in the above embodiment can be appropriately replaced with a known component, and the above variation may be appropriately combined without departing from the scope of the present invention.

What is claimed is:

1. A liquid jet head comprising:

a base plate;

an actuator portion fixed to the base plate and having a jet channel to be filled with a liquid and a dummy channel not to be filled with a liquid, the jet channel and the dummy channel being juxtaposed to each other;

a jet hole plate arranged on one side end of the actuator portion in an extending direction of the jet channel and the dummy channel, the jet hole plate having a jet hole configured to communicate with the jet channel;

a drive electrode formed on inner surfaces of the jet channel and the dummy channel; and an extracting electrode formed on the base plate on the other side end of the actuator portion in the extending direction, the extracting electrode being electrically connected to the drive electrode, wherein an electrode formation region of the base plate on which is formed the extracting electrode has a surface roughness greater than a surface roughness in a region of the base plate other than the electrode formation region.

2. The liquid jet head according to claim 1, wherein the drive electrode and the extracting electrode are integrally formed with a plated film.

3. The liquid jet head according to claim 1, wherein a surface roughness Ra of the electrode formation region is equal to or more than four times as great as a surface roughness Ra of the region other than the electrode formation region.

4. The liquid jet head according to claim 1, wherein the surface roughness Ra of the electrode formation region is equal to or more than 400 Å.

5. The liquid jet head according to claim 1, wherein the base plate is made of glass material.

6. The liquid jet head according to claim 1, wherein the drive electrode comprises a common electrode formed on the inner surface of the jet channel, a ground terminal is connected to the extracting electrode and is formed in the actuator portion outside the dummy channel located in an outermost end in a juxtaposed direction of the jet channel and the dummy channel, a cover plate having a liquid chamber configured to communicate with the jet channel is arranged on a main surface of the actuator portion on a side opposite to a side of the base plate, and a connection wiring is formed in the cover plate to connect the common electrode to the ground terminal.

7. The liquid jet head according to claim 6, wherein the drive electrode comprises an individual electrode formed on the inner surface of the dummy channel, a groove portion is formed in the main surface of the actuator portion between the common electrode and the individual electrode, and the connection wiring is arranged in a position corresponding to the groove portion.

8. The liquid jet head according to claim 1, wherein the actuator portion comprises channel blocks arranged at intervals in the juxtaposed direction of the jet channel and the dummy channel, and a jet channel is formed in each of the channel blocks, a dummy channel is made up between each two adjacent channel blocks and the base plate, the drive electrode comprises an individual electrode formed on opposed surfaces of the channel blocks configured to constitute the dummy channels, and the region other than the electrode formation region includes a portion of the base plate making up the dummy channels.

9. A method for manufacturing the liquid jet head according to claim 1, comprising the steps of:

roughening the electrode formation region in the base plate;

bonding and fixing the actuator portion to the base plate; and forming electrodes with a plated film on the electrode formation region in the base plate, the inner surfaces of the jet channel, and the inner surfaces of the dummy channel.

10. A liquid jet apparatus comprising:

the liquid jet head according to claim 1; and a moving mechanism configured to relatively move the liquid jet head and a recording medium.

11. A liquid jet head comprising:

a base plate;

an actuator portion attached to a main surface of the base plate and having ejection channels for ejecting liquid and dummy channels that do not eject liquid, the ejection channels and the dummy channels being alternately arrayed and separated from one another by side walls made of piezoelectric material;

a nozzle plate attached to the actuator portion and having holes that communicate with respective ejection channels for ejecting liquid droplets;

drive electrodes formed on the side walls that separate and form the ejection channels and the dummy channels; and extracting electrodes formed on an electrode formation region of the main surface of the base plate and electrically connected to the drive electrodes, wherein the electrode formation region has a surface roughness greater than a surface roughness of other regions of the main surface of the base plate.

12. A liquid jet head according to claim 11;

wherein the nozzle plate is attached to a front side of the actuator portion and the electrode formation region is located at a rear side of the actuator portion.

13. A liquid jet head according to claim 11;

wherein the drive electrodes and the extracting electrodes are comprised of a plated film.

14. A liquid jet head according to claim 11;

wherein a surface roughness Ra of the electrode formation region is at least four times greater than a surface roughness Ra of the other regions of the base plate.

15. A liquid jet head according to claim 11;

wherein a surface roughness Ra of the electrode formation region is equal to or greater than 400 Å.

16. A liquid jet head according to claim 15;

wherein the base plate is made of glass material.

17. A liquid jet head according to claim 11;

wherein the drive electrodes include common electrodes formed on opposed, facing side walls and on bottom walls of the ejection channels; and further comprising a ground terminal formed on the actuator portion; a cover plate attached to the actuator portion and covering the ejection channels and the dummy channels, the cover plate having a liquid chamber communicating with the ejection channels; and a connection wiring formed on the cover plate and electrically connecting the common electrodes to the ground terminals.

18. A liquid jet head according to claim 17;

wherein the drive electrodes include individual electrodes formed on opposed, facing side walls of the dummy channels, and the connection wiring extends in a groove formed in the actuator portion between the common electrodes and the individual electrodes.

19. A liquid jet head according to claim 11;

wherein the bottoms of the dummy channels are closed by the main surface of the base plate.

20. A liquid jet head according to claim 19;

wherein the regions of the main surface of the base plate closing the bottoms of the dummy channels do not constitute part of the electrode formation region.

* * * * *